United States Patent [19]

Matsuda

[11] Patent Number: 4,502,302

[45] Date of Patent: Mar. 5, 1985

[54] KNITTED SUPPORT TAPE OF SLIDE FASTENER

[75] Inventor: Yoshio Matsuda, Toyama, Japan

[73] Assignee: Yoshida Kogyo K. K., Tokyo, Japan

[21] Appl. No.: 549,742

[22] Filed: Nov. 8, 1983

Related U.S. Application Data

[63] Continuation of Ser. No. 283,106, Jul. 13, 1981, abandoned.

[30] Foreign Application Priority Data

Aug. 8, 1980 [JP] Japan ..... 55/109662

[51] Int. Cl.[3] ..... D04B 23/08

[52] U.S. Cl. ..... 66/193

[58] Field of Search ..... 66/192, 190, 193, 195

[56] References Cited

U.S. PATENT DOCUMENTS

| | | | |
|---|---|---|---|
| 4,047,265 | 9/1977 | Matsuda | 66/195 |
| 4,052,866 | 10/1977 | Saunders | 66/193 |
| 4,067,208 | 1/1978 | Heimberger | 66/193 |
| 4,228,566 | 10/1980 | Matsuda | 66/190 |
| 4,248,064 | 2/1981 | Odham | 66/190 X |

OTHER PUBLICATIONS

Reisfeld, "Warp Knit Engineering", Nat. Knitted Outerwear Times, 1966, pp. 410 to 416.

*Primary Examiner*—Ronald Feldbaum

*Attorney, Agent, or Firm*—Hill, Van Santen, Steadman & Simpson

[57] ABSTRACT

A warp-knit support tape of a slide fastener having wales extending longitudinally of the tape is disclosed in which a stitching area opposite the fastener element mounting area along one side of the tape has a knit structure consisting only of yarns meandering between at least two wales thereby giving the area longitudinal stretchability. The other portion of the tape is made hard to stretch in the longitudinal direction. According to one embodiment, the fastener element mounting area includes laid-in warps for further enhancing resistance against longitudinal deformation of the area. According to another embodiment, the middle area includes laid-in wefts of stretchable yarns disposed to extend across all the wales in the middle area.

3 Claims, 6 Drawing Figures

KNITTED SUPPORT TAPE OF SLIDE FASTENER

This is a continuation of application Ser. No. 283,106, filed 07/13/81 now abandoned.

BACKGROUND OF THE INVENTION

This invention relates to support tapes of a slide fastener. More particularly, the invention relates to support tapes of warp-knit material which are stretchable at side areas opposite the fastener element mounting areas so that the tapes may be easily bent in the plane including the tapes.

When a slide fastener is mounted so that it is bent in the plane including the support tapes thereof, the outer side portions of the tapes should be expandable lengthwise. Heretofore, in either woven tapes or knitted tapes, such strechability has been attained by elastic yarns forming a part of woven or knitted structure and disposed to extend in the direction in which the tapes should stretch. One example of such strechable tape is disclosed in U.K. Pat. No. 1,396,577. When support tapes using elastic yarns are fixed along a way which is bent in the plane including the tapes, the outer tape at a corner of the way is secured by, for example sewing, to a member on which a slide fastener is to be mounted while the outer tape is longitudinally stretched. The stretched tape tends to return to its original position and this creates substantial force. Therefore, there is a problem that upon release of the force for stretching the tape after sewing, the portion of the member to which the tape is secured at the corner corrugates together with the tape resulting in impaired appearance. Furthermore, due to the high elastic constant of the elastic yarns, a relatively large tensile force remains after sewing in the outer tape at the corner. Therefore, another problem is that this tensile force adversely affect the position of the fastener elements and may make the interengagement unreliable.

SUMMARY OF THE INVENTION

An object of the invention is to eliminate the aforementioned problems by providing a support tape of warp-knit material having longitudinal stretchability at the area to be sewn to another member opposite to a fastener element mounting area without relying on elastic yarns.

Another object of the invention is to provide a support tape in which the middle area is laterally stretchable, whereby the degree by which fastener elements are affected by a force laterally imparted to the tape is decreased.

According to the invention, a support tape is made by warp-knit material in which wales extend longitudinally of the tape. The area of the support tape opposite the fastener element mounting area has a knit structure consisting only of yarns meandering between at least two wales. Therefore, this area is made longitudinally stretchable.

In one embodiment of the invention, a support tape is divided into three areas, namely an element mounting area along one side of the tape, the middle area and a stitching area along the other side of the tape. These areas have respective different knit structures. The element mounting area is provided with laid-in warps intertwined therewith, thereby enhancing resistance against longitudinal deformation of the area.

In another embodiment of the invention, a support tape is divided into three areas as in the first embodiment. In this embodiment, the middle area is made laterally stretchable by a laid-in weft of elastic yarn intertwined in the area so that it extends across the whole width of the area.

BRIEF DESCRIPTION OF THE DRAWINGS

Other objects and advantages of the invention will be clear from the following description referring to the drawings, in which.

DETAILED DESCRIPTION OF THE PREFERRED EMBODIMENT

Figure 1:
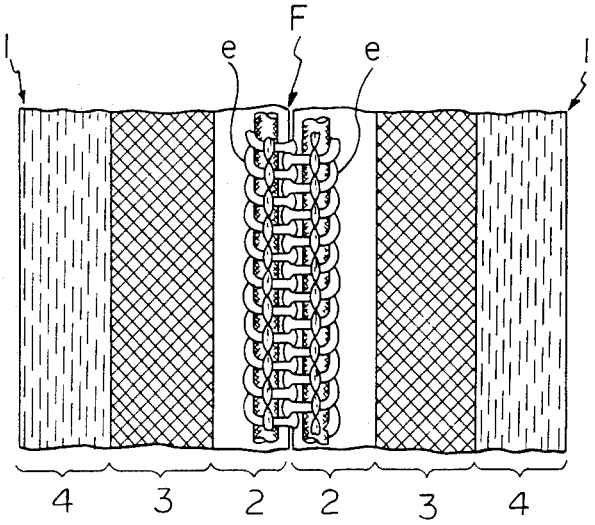
FIG. 1 is a plan view of a slide fastener having support tapes made according to the invention.

FIG. 1 shows a portion of a slide fastener F comprising two support tapes 1 made according to the invention and interengaging coil type fastener elements "e". Each fastener element is sewn on the inner side area of one of the tapes 1. As is illustrated, each tape 1 is divided widthwise into three areas, namely from the inner side of the tape an element mounting area 2, the middle area 3 and a stitching area 4 at which the tape is sewn on another member, such as clothes and bags. These areas have respective different knit structures.

Figure 2:
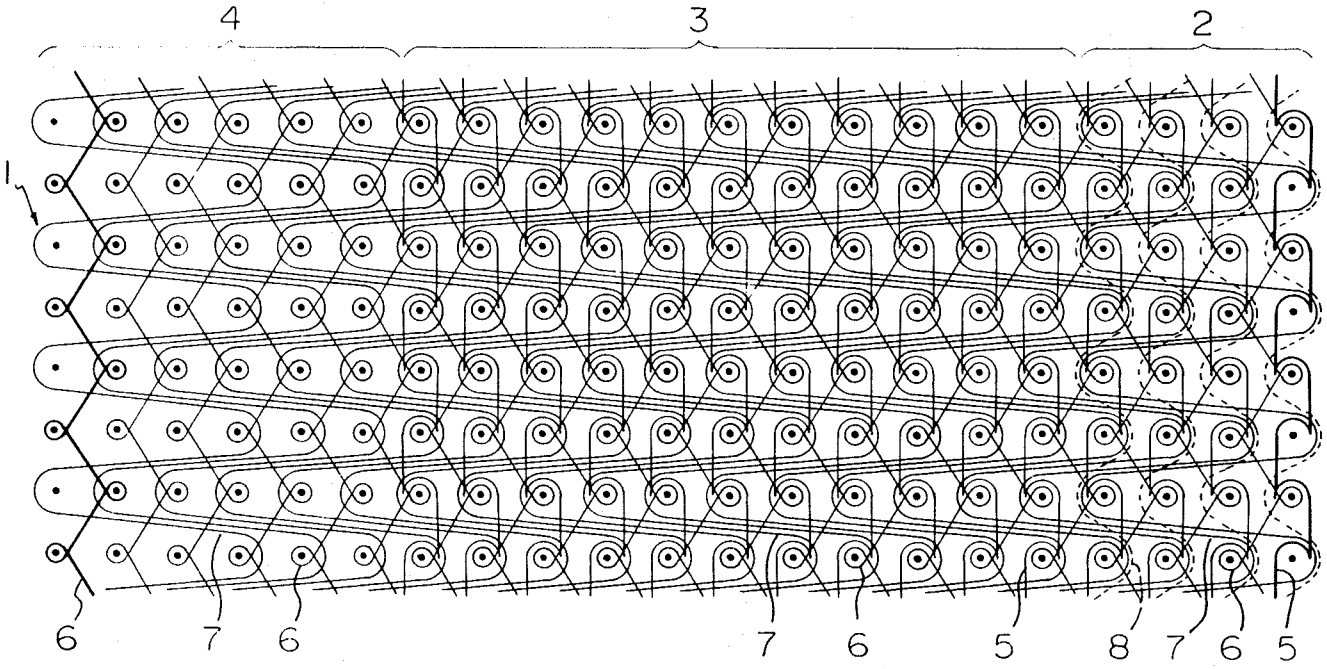
FIG. 2 is a schematic illustration of the knit construction of a support tape according to one embodiment of the invention.
Figure 3:
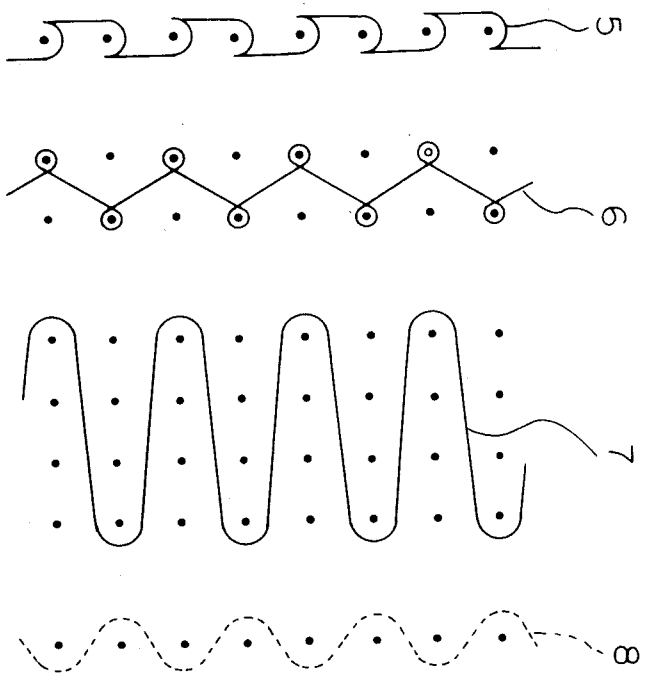
FIG. 3 is a schematic illustration of the respective stitches and laid-in yarns composing the knit construction shown in FIG. 2.

FIGS. 2 and 3 show a knit construction of a support tape 1 according to one embodiment of the invention. The tape has a warp-knit structure in which wales extend longitudinally of the tape and the element mounting area 2 consists of chain stitches 5 of the pattern (1-0/0-1), tricot stitches 6 of the pattern (1-2/1-0), laid-in wefts 7 of the pattern (0-0/4-4) and laid-in warps 8 of the pattern (0-0/1-1). The chain stitches 5 are hard to longitudinally stretch and the laid-in wefts 7 are hard to laterally stretch. Therefore, it will be appreciated that the abovedescribed structure is made non-stretchable in both longitudinal and lateral directions. The laid-in warps 8 further enhance resistance against longitudinal deformation of this area, resulting in the area 2 having a more dense and reliable structure. The innermost chain stitch 5 is made by a thick reinforcing yarn to further strengthen the inner edge of the tape against longitudinal deformation. The middle area 3 has a structure which is the same as that of the element mounting area 2 except that it does not have laid-in warps 8. The stitching area 4 is composed of yarns meandering between at least two wales. Particularly, it comprises tricot stitches 6 of the pattern (1-2/1-0) and laid-in wefts 7 of the pattern (0-0/4-4). Since this area is coarser than the other areas and does not have chain stitches, the knit structure thereof allows the area to longitudinally stretch. In this embodiment, a thick reinforcing yarn is used as the tricot stitch 6 at the outer edge of the stitching area 4 of the support tape 1. If thick reinforcing yarns are used for all the threads of one of the group forming tricot stitches 6 and the group of the laid-in wefts 7, the thickness of the stitching area 4 becomes comparable to the other areas 2 and 3 and the area keeps enough strength desired for the tape in spite of a coarse structure. It will be appreciated that the laid-in wefts may be disposed in the pattern (0-0/4-4), (0-1/4-3) or (1-0/3-4).

Figure 4:
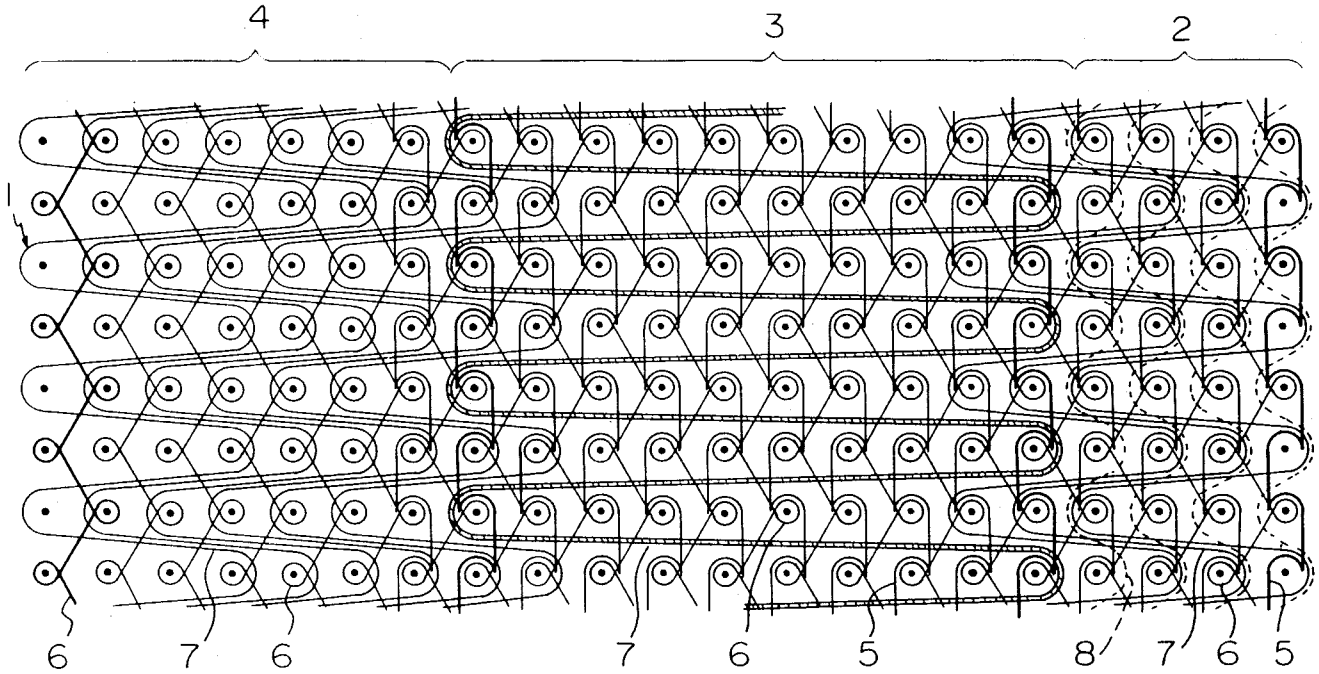
FIG. 4 is a schematic illustration of the knit construction of a support tape according to another embodiment of the invention.
Figure 5:
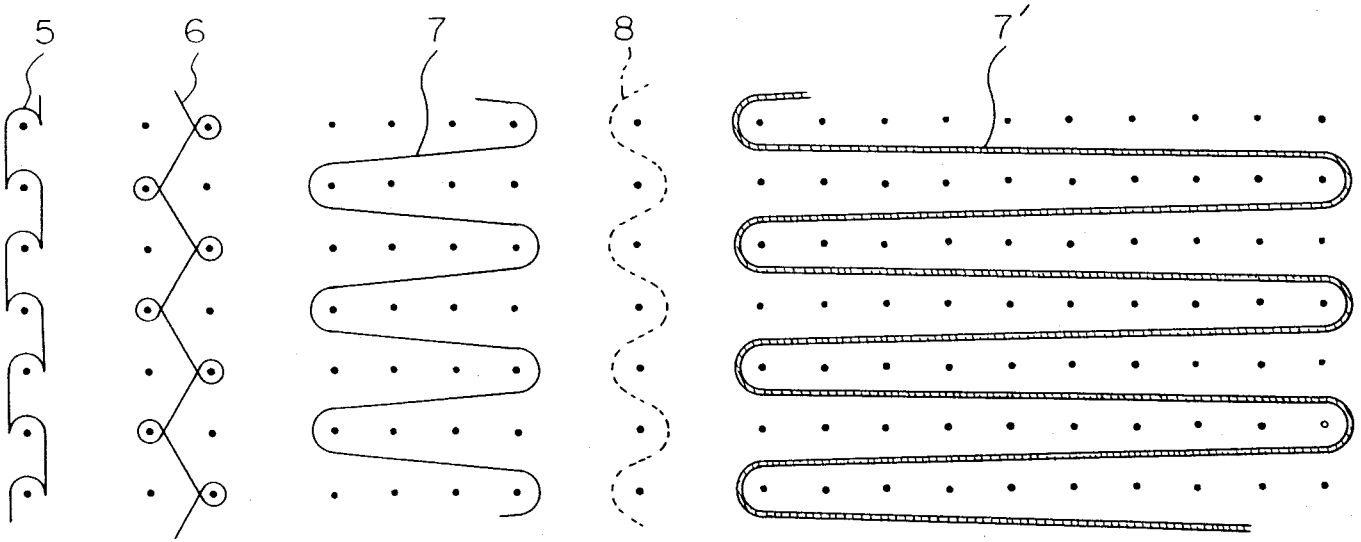
FIG. 5 is a schematic illustration of the respective stitches and laid-in yarns composing the knit construction shown in FIG. 4.

The embodiment shown in FIGS. 4 and 5 is similar to the embodiment described above with reference to FIGS. 2 and 3. The difference is only in the knit structure of the middle area 3. The knit structure of the middle area 3 consists of chain stitches 5 of the pattern (1-0/0-1), tricot stitches 6 of the pattern (1-2/1-0) and laid-in weft 7' of elastic yarn of the pattern (0-0/10-10). In each of the wales around which the laid-in weft 7' turns, a thick reinforcing yarn is used as the chain stitch 5 thereby preventing the wale from being displaced by the force imparted from the elastic laid-in weft 7'. It is possible to use a thick reinforcing yarn for the tricot stitch instead of the chain stitch in these wales. Elastic yarns may include covered yarns in which a spandex thread or rubber thread is wound on a core thread. According to this particular knit structure, the middle area 3 does not stretch longitudinally but may expand laterally due to the laid-in weft 7' of elastic yarn.

Figure 6:
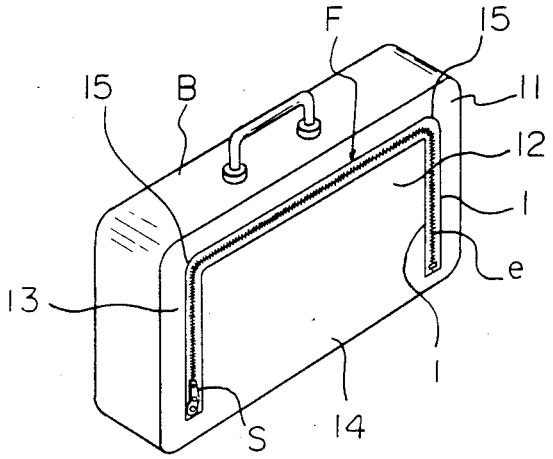
FIG. 6 is a perspective view of a bag on which a slide fastener having support tapes according to the invention is mounted.

FIG. 6 shows a bag B on which a slide fastener F having support tapes 1 of this invention is mounted. The bag B has an opening 12 on the front side 11 thereof so that the edge of the opening 12 forms a one-side-open rectangle. The slide fastener F is secured along the edge of the opening 12 to connect the body 13 and a cover 14 of the bag to each other. The slide fastener F is mounted on the bag B so that the plane of the support tapes 1 is parallel with the front side 11. Therefore, the tapes 1 are bent in the plane in which they extend. Therefore, when the support tapes 1 are mounted on the bag B, the stitching area 4 of the outer tape is stretched and the stitching area 4 of the inner tape is contracted at the corners 15 of the opening 12. According to the invention, stitching areas 4 of the support tapes 1 are stretchable without relying on elastic yarns. Therefore, after being sewn on the bag B, the stitching area 4 of the outer tape 1 stretched at the corners 15 does not create substantial force as it tends to return to its original position. Therefore, there is little tendency for the portions of the bags B around the corners 15 of the opening 12 to corrugate. Furthermore, due to the knit structure described above, the stitching areas 4 of the support tapes 1 can easily deform too when they are longitudinally compressed. Therefore, when the stitching area 4 of the inner tape 1 is contracted at the corner 15 as it is sewn on the bag B it does not corrugate. It will also be appreciated that easy deformability of the support tapes 1 prevents the position of the fastener elements "e" from being adversely affected by the force imparted by the stretched tapes.

According to the second embodiment of the invention, the middle area 3 of the support tape 1 is laterally expandable. Therefore, when the bag B expands because it is too full, the laterally stretchable middle area 3 alleviates stress imparted to the fastener elements "e". This makes the operation of a slider S smooth and prevents separation of the fastener stringers.

What is claimed is:

1. A support tape of warp-knit material for a slide fastener comprising:

(a) a first area extending along one side of said support tape and having a structure making it hard to stretch longitudinally and laterally, said first area being provided for supporting a row of fastener elements;

(b) a second area extending along the side of said support tape opposite said first area and at which said tape is sewn on a member to which it should be attached, said second area being formed of only weft yarns laid-in extending laterally coursewise of a plurality of wales and tricot stitches extending transversely laterally of said weft yarns coursewise between at least two wales making said second area relatively easy to stretch longitudinally;

(c) a third area between said first and second areas having laid-in wefts and tricot stitches.

2. The support tape of claim 1, wherein said second area consists of tricot stitches in the pattern 1-2/1-0 and laid-in wefts in the pattern 0-0/4-4.

3. The support tape of claim 1, further comprising said third area between said first and second areas having laid-in wefts of stretchable yarns which are laid-in to extend across the whole width of said third area for lateral stretchability.

* * * * *